US007336028B2

(12) United States Patent
Lee

(10) Patent No.: US 7,336,028 B2
(45) Date of Patent: Feb. 26, 2008

(54) ELECTRON EMISSION DEVICE HAVING MULTI-LAYERED GATE ELECTRODE STRUCTURE

(75) Inventor: Sang-Jin Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 209 days.

(21) Appl. No.: 10/925,208

(22) Filed: Aug. 23, 2004

(65) Prior Publication Data

US 2005/0077813 A1 Apr. 14, 2005

(30) Foreign Application Priority Data

Oct. 9, 2003 (KR) ..... 10-2003-0070198

(51) Int. Cl.
*H01J 1/62* (2006.01)

(52) U.S. Cl. ..... 313/497; 313/495; 313/496

(58) Field of Classification Search ..... 313/495–497
See application file for complete search history.

(56) References Cited

U.S. PATENT DOCUMENTS

2003/0094892 A1* 5/2003 Moradi et al. ..... 313/495
2003/0107311 A1* 6/2003 Radigan et al. ..... 313/495
2004/0012327 A1* 1/2004 Shiratori et al. ..... 313/497

* cited by examiner

*Primary Examiner*—Joseph Williams
*Assistant Examiner*—Bumsuk Won
(74) *Attorney, Agent, or Firm*—Christie, Parker & Hale, LLP

(57) ABSTRACT

An electron emission device and a manufacturing method thereof. The electron emission device includes a first substrate and a second substrate opposing one another with a predetermined gap therebetween. The first and second substrates are interconnected using a sealant to thereby form a vacuum assembly. Cathode electrodes are formed on the first substrate, and electron emission sources are formed on the cathode electrodes. Further, gate electrodes are mounted on the cathode electrodes with a first insulation interposed therebetween. The gate electrodes are formed in a multi-layered structure of at least two layers. An anode electrode is formed on the second substrate, and a phosphor screen is formed on the anode electrode.

8 Claims, 9 Drawing Sheets

ELECTRON EMISSION DEVICE HAVING MULTI-LAYERED GATE ELECTRODE STRUCTURE

CROSS REFERENCE TO RELATED APPLICATION

This application claims priority to and the benefit of Korea Patent Application No. 2003-0070198 filed on Oct. 9, 2003 in the Korean Intellectual Property Office, the content of which is incorporated herein by reference.

BACKGROUND OF THE INVENTION (a) Field of the Invention

The present invention relates to an electron emission device. More particularly, the present invention relates to an electron emission device and a manufacturing method thereof in which the electron emission device includes gate electrodes arranged on cathode electrodes with an insulation layer interposed therebetween, the gate electrodes controlling the emission of electrons from emitters.

(b) Description of the Related Art

Generally, the electron emission devices are classified into a first type where a hot cathode is used as an electron emission source and a second type where a cold cathode is used as the electron emission source. Among the second type electron emission devices there are field emitter array (FEA) types, surface conduction emitter (SCE) types, metal-insulator-metal (MIM) types, metal-insulator-semiconductor (MIS) types, and ballistic electron surface emitting (BSE) types.

The FEA type utilizes the tunneling effect of quantum mechanics to emit electrons from electron emission sources formed on cathode electrodes. The emitted electrons strike a phosphor layer formed on an anode electrode to illuminate the phosphor layer and thereby result in the display of images. The cathode electrodes, the gate electrodes, and the anode electrode form what is referred to as a triode structure. The triode structure is widely used in FEA types.

FIG. 8 is a partial sectional view of a conventional FEA types.

Cathode electrodes 3, insulation layer 5, and gate electrodes 7 are formed on backplate 1, and anode electrode 11 and phosphor layer 13 are formed on faceplate 9. Cathode electrodes 3 are formed in a stripe pattern and gate electrodes 7 are formed in a stripe pattern such that cathode electrodes 3 intersect gate electrodes 7 substantially perpendicular. First and second openings 5*a* and 7*a* are formed respectively in insulation layer 5 and gate electrodes 7 corresponding to where cathode electrodes 3 and gate electrodes 7 intersect. Emitters 15, which act as electron emission sources, are formed on surfaces of cathode electrodes 3 exposed by first and second openings 5*a* and 7*a*.

Such emitters 15 are formed by performing deposition through a thick-layer process (e.g., screen printing) using a carbon-based material such as carbon nanotubes or graphite, after which baking is performed. Compared to Spindt-type emitters, manufacture is simple and the resulting emitters are more suitable for use in devices of large screen sizes.

However, when material for forming emitters 15 is deposited on cathode electrodes 3 using a thick-layer process, it is possible for the conductive emitter material to be inadvertently formed extending from cathode electrodes 3 to gate electrodes 7 to thereby form a short circuit between these two elements. Therefore, a sacrificial layer is used in the formation of emitters 15 to thereby prevent the formation of short circuits.

FIGS. 9*a*-9*d* are partial sectional views used to describe the processes involved in forming emitters in the production of the conventional FEA types.

Referring first to FIG. 9*a*, cathode electrodes 3, insulation layer 5, and gate electrodes 7 are formed in this sequence on backplate 1. Next, first and second openings 5*a* and 7*a* are formed respectively in and passing fully through insulation layer 5 and gate electrodes 7 at areas corresponding to where cathode electrodes 3 and gate electrodes 7 intersect. Backplate 1 is made of a transparent glass substrate, and cathode electrodes 3 are made of a transparent conducting film having a high transmissivity of light such as ITO (indium tin oxide).

Subsequently, except for specific areas of cathode electrodes 3 (i.e., areas exposed by first and second openings 5*a* and 7*a*), sacrificial layer 17 is formed over all exposed areas of gate electrodes 7, insulation layer 5, and cathode electrodes 3. Sacrificial layer 17 is made of a conventional photoresist material or a metal.

Next, with reference to FIG. 9*b*, paste-like emitter material 19 is deposited using a thick-layer process over all exposed elements formed on backplate 1, that is, over sacrificial layer 17 and the exposed portions of cathode electrodes 3. Next, ultraviolet rays (depicted by dark arrows) are irradiated onto a surface of backplate 1 opposite the side on which the above elements are formed to thereby selectively harden emitter material 19 on cathode electrodes 3.

Following the above processes, with reference to FIG. 9*c*, emitter material 19 that has not been hardened is removed. Baking is then performed to thereby complete the formation of emitters 15. Next, etching is performed using an etching solution to remove sacrificial layer 17 as shown in FIG. 9*d*. This completes the formation of the structure present on backplate 1.

However, there is a serious problem with the configuration realized through the processes described above. In particular, the etching solution used to remove sacrificial layer 17 may damage gate electrodes 7. Gate electrodes 7 are typically made of a thin metal having a thickness of approximately 200 nm. The cross-sectional area of gate electrodes 7 is reduced by damage to the surface of gate electrodes 7 by the etching solution. This results in an increase in the line resistance of gate electrodes 7 and/or cracking of the gate electrodes when emitter material 19 is baked.

When predetermined drive voltage are applied to cathode electrodes 3 and gate electrodes 7 to effect the emission of electrons from emitters 15 (in this increased state of resistance of gate electrodes 7), the voltage applied to gate electrodes 7 is reduced. Ultimately, this results in a non-uniform emission of electrons from emitters 15 which significantly reduces overall picture quality.

SUMMARY OF THE INVENTION

In one exemplary embodiment of the present invention, there is provided an electron emission device and a manufacturing method thereof in which damage to the gate electrodes when removing a sacrificial layer using an etching solution is prevented such that there is no increase in the resistance of the gate electrodes, thereby resulting in a high degree of emission uniformity of the electron emission device.

In an exemplary embodiment of the present invention, an electron emission device includes a first substrate and a second substrate opposing one another with a predetermined gap therebetween. The first and second substrates are interconnected using a sealant to thereby form a vacuum assembly. Cathode electrodes are formed on the first substrate, and electron emission sources are formed on the cathode electrodes. Further, gate electrodes are mounted on the cathode electrodes with a first insulation interposed therebetween. The gate electrodes are formed in a multi-layered structure of at least two layers. An anode electrode is formed on the second substrate, and a phosphor screen is formed on the anode electrode.

Each of the layers forming the gate electrodes is made of metal, and each of the gate electrodes includes a first gate layer and a second gate layer made of different metals. Preferably, the first and second gate layers are etched by etchants different from each other. Further, the gate electrodes are made of a multi-layered structure of one of combinations of chrome and silver, chrome and aluminum, and aluminum and silver.

The electron emission device may also include focusing electrodes mounted on the gate electrodes with a second insulation layer interposed therebetween.

A method of manufacturing an electron emission device includes forming cathode electrodes on a transparent first substrate, where the cathode electrodes are made of a conductive material having a high transmissivity of light. The method also includes forming an insulation layer over an entire surface of the first substrate on which the cathode electrodes are formed, forming first gate layers on the insulation layer, and forming openings that pass through the first gate layers and the insulation layer. In addition, second gate layers are formed on the first gate layers. The second gate layers have openings corresponding to the openings of the first gate layers and the insulation layer. In addition, a sacrificial layer is formed over all exposed elements of the first substrate, and portions of the sacrificial layer at areas where the cathode electrodes are exposed through the openings are removed. The method further includes depositing a paste-like photosensitive emitter material over all exposed elements of the first substrate, and irradiating ultraviolet rays onto a surface of the first substrate opposite the surface on which the above elements are formed to thereby selectively harden the emitter material that is present on the cathode electrodes to form electron emission sources. Finally, the sacrificial layer is removed.

DETAILED DESCRIPTION

Figure 1:
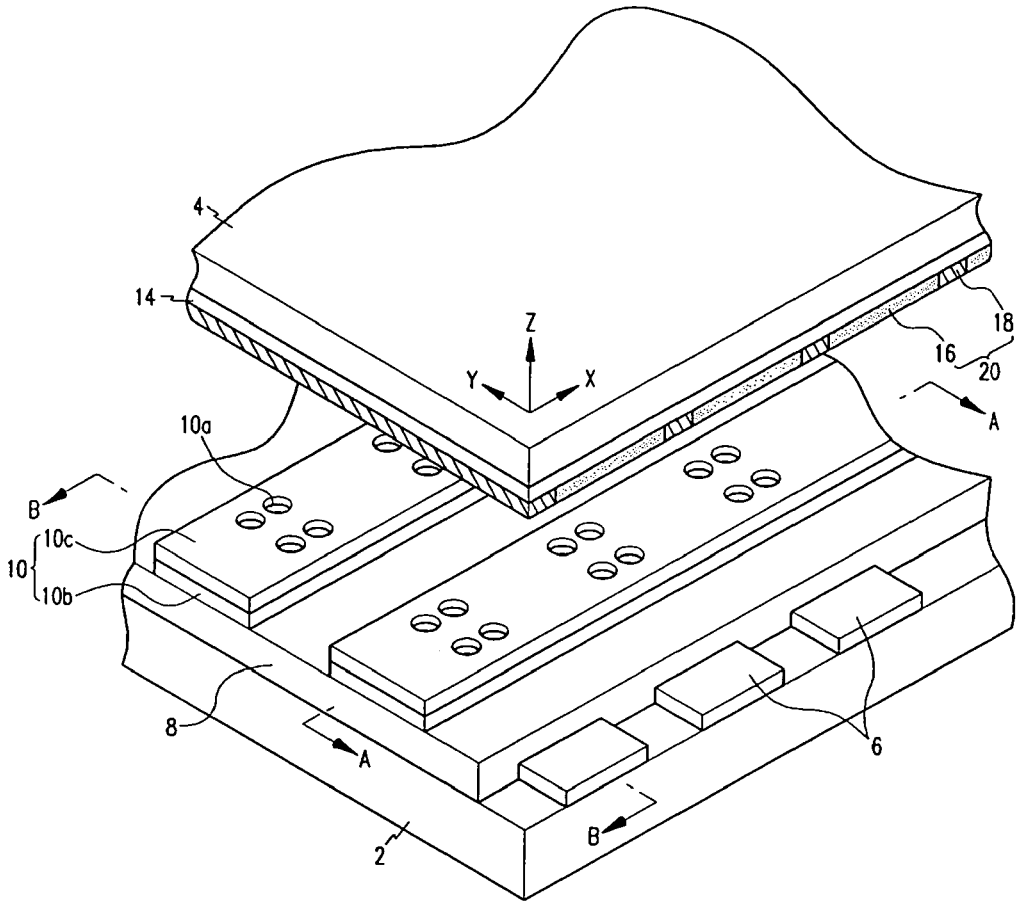
FIG. 1 is a partial exploded perspective view of an electron emission device according to an exemplary embodiment of the present invention.
Figure 2:
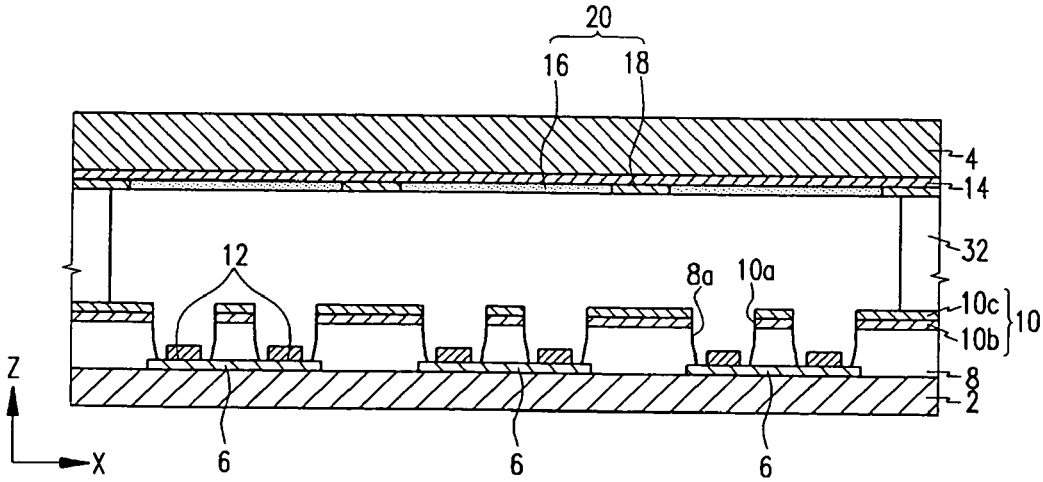
FIG. 2 is a sectional view taken along line A-A of FIG. 1.
Figure 3:
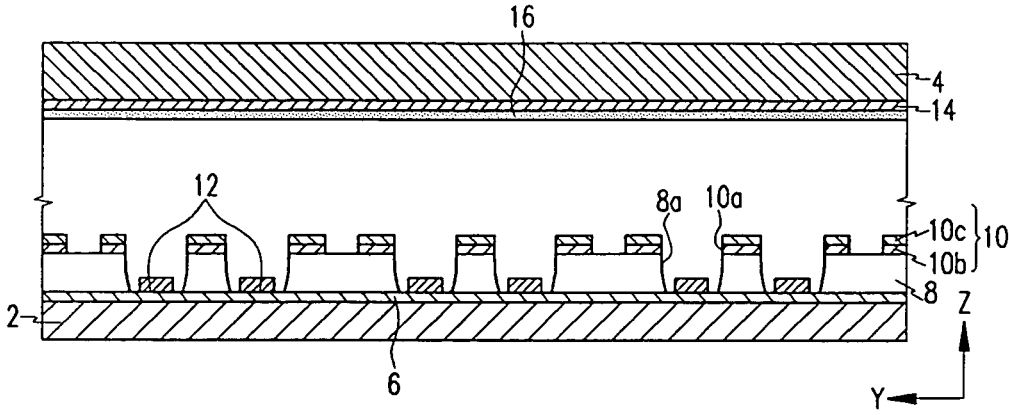
FIG. 3 is a sectional view taken along line B-B of FIG. 1.

Referring to FIGS. 1, 2 and 3, an FEA type electron emission device is illustrated. As shown in the drawings, the electron emission device includes first substrate 2 and second substrate 4 provided substantially in parallel with a predetermined gap therebetween. First substrate 2 and second substrate 4 are interconnected by providing a sealant (not shown) such as frit along outside opposing edges to thereby form a vacuum assembly. An assembly for realizing the emission of electrons is formed on first substrate 2, and an assembly for realizing the display of images is formed on second substrate 4.

In more detail, cathode electrodes 6 are formed on a surface of first substrate 2 opposing second substrate 4. Cathode electrodes 6 are formed on a surface along one direction (direction Y in the drawings) and in a stripe pattern. Insulation layer 8 is formed over an entire surface of first substrate 2 covering cathode electrodes 6. Further, gate electrodes 10 are formed on insulation layer 8 in a stripe pattern and along a direction (direction X in the drawings) substantially perpendicular to the direction cathode electrodes 6 are formed. Openings 8*a* and 10*a* are respectively formed in insulation layer 8 and gate electrodes 10 at areas corresponding to where cathode electrodes 6 and gate electrodes 10 intersect. Openings 8*a* and 10*a* expose cathode electrodes 6.

Electron emission sources, that is, emitters 12, are formed on surfaces of cathode electrodes 6 exposed by openings 8*a* and 10*a*. Emitters 12 are positioned at a predetermined distance from insulation layer 8 and gate electrodes 10 so that a short circuit is not formed between emitters 12 and gate electrodes 10. Emitters 12 are realized using a carbon-based material such as carbon nanotubes, graphite, diamond, diamond-like carbon (DLC), $C_{60}$ (Fullerene), or a combination of these materials. In the first embodiment, carbon nanotubes are used for emitters 12.

During operation of the device, a negative voltage of a few to a few tens of volts is applied to cathode electrodes 6, and a positive voltage of a few to a few tens of volts is applied to gate electrodes 10. As a result of the voltage difference between cathode electrodes 6 and gate electrodes 10, electric fields are formed in the peripheries of emitters 12 such that electrons are emitted from the same.

Anode electrode 14 is formed on the surface of second substrate 4 opposing first substrate 2, and phosphor screen 20 is formed on anode electrode 14 with red, green, and blue phosphor layers 16 and black matrix 18. Anode electrode 14 is formed with a transparent conductive material, such as ITO. A positive voltage of a few hundred to a few thousand volts is applied to anode electrode 14 such that electrons emitted from emitters 12 are accelerated toward phosphor screen 20.

Meanwhile, a metallic layer (for example aluminum layer) may be formed on phosphor screen 20 to heighten the screen brightness by the metal back effect. In this case, the metallic layer may be used as an anode electrode while omitting the transparent electrode.

In the electron emission device of this exemplary embodiment, gate electrodes 10, which operate together with cathode electrodes 6 to effect the emission of electrons from emitters 12, have a multi-layered structure with at least two layers. In particular, gate electrodes 10 include first and second gate layers 10*b* and 10*c* made of different metals.

By forming gate electrodes 10 using this multi-layered structure that includes first and second gate layers 10*b* and 10*c*, damage to gate electrodes 10 occurring during device manufacture is such that only second gate layers 10*c* may become damaged while first gate layers 10*b* are left unharmed. Such a multi-layered structure is especially advantageous in the case where manufacture includes the steps of forming a sacrificial layer, then using an etching solution to remove the sacrificial layer following formation of emitters 12. That is, this multi-layered structure of gate electrodes 10 minimizes damage to gate electrodes 10 during such production processes.

Therefore, damage to first gate layers 10*b* that are in direct contact with insulation layer 8 is prevented such that first gate layers 10*b* maintain their low level of resistance. The end result of this is that gate electrodes 10 remain highly conductive, and a drop in voltage of gate electrodes 10 is prevented.

Preferably, a thickness of each of first gate layers 10*b* and second gate layers 10*c* is 100-500 nm, and a combined thickness of each pair of first and second gate layers 10*b* and 10*c* is 200-1000 nm. If the thickness of each of first and second gate layers 10*b* and 10*c* is less than 100 nm, many defects are present on first and second gate layers 10*b* and 10*c* such that ultraviolet rays (depicted by the dark arrows) pass through these elements when exposing the emitter material. That is, gate electrodes 10 are unable to perform one of their functions as an exposure mask. Also, such a minimal thickness results in increasing the resistance of gate electrodes 10 so that they lose their ability to function as electrodes. On the other hand, if the thickness of each of first and second gate layers 10*b* and 10*c* exceeds 500 nm, the time required to produce gate electrodes 10 is increased. Also increased is the time needed to perform etching for electrode patterning, and this, in turn, increases the possibility of damage to insulation layer 8.

When first and second gate layers 10*b* and 10*c* are etched by etchants different from each other, the above advantages realized by such a multi-layered structure of different metals are better realized. Examples of different combinations of metals that may be used for first and second gate layers 10*b* and 10*c* include chrome (Cr) and silver (Ag), chrome (Cr) and aluminum (Al), and aluminum (Al) and silver (Ag). These materials may be interchanged and do not necessarily correspond respectively to first gate layers 10*b* and second gate layers 10*c*. For example, in the case of the chrome and silver combination, the chrome may be used for first gate layers 10*b* or second gate layers 10*c*, and the same is true for the silver.

With the formation of gate electrodes 10 using such a stacked structure of first and second layers 10*b* and 10*c* as described above, damage to gate electrodes 10 occurring during the etching process of device manufacture is such that gate electrodes 10 nevertheless maintain their required level of conductivity. Therefore, emission uniformity of emitters 12 is maintained and picture quality is enhanced.

Figure 4:
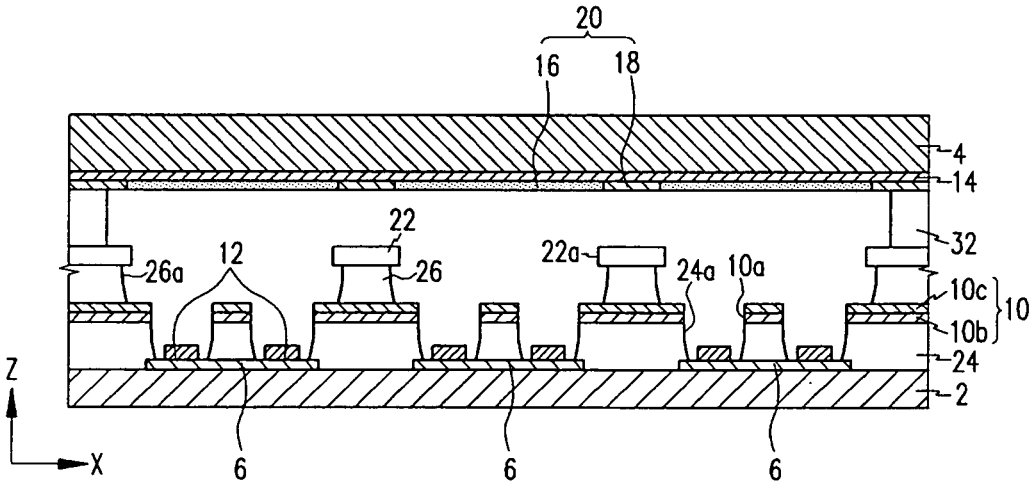
FIG. 4 is a partial sectional view of an electron emission device according to another exemplary embodiment of the present invention.

FIG. 4 is a partial sectional view of an electron emission device according to another exemplary embodiment of the present invention. This exemplary embodiment uses the basic structure of the exemplary embodiment described with reference to FIG. 1. However, added to the basic structure are focusing electrodes 22 formed on gate electrodes 10. The formation and structure of focusing electrodes 22 are described below.

Insulation layer 24 formed between cathode electrodes 6 and gate electrodes 10 is referred to in this case as a first insulation layer. In addition, second insulation layer 26 is formed to a predetermined thickness on gate electrodes 10. Focusing electrodes 22 are then formed on second insulation layer 26. So that emitters 12 remain exposed, openings 22*a* and 26*a* are formed respectively in focusing electrodes 22 and second insulation layer 26. Openings 22*a* and 26*a* communicate with openings 24*a* and 10*a*.

By applying a positive voltage of a few tens to a few hundred volts to focusing electrodes 22, the electrons emitted from emitters 12 are focused by the positive potential of focusing electrodes 22 while passing the same (i.e., while passing through openings 22*a* thereof), thereby minimizing scattering of the resulting electron beams. Accordingly, in the present exemplary embodiment, the electrons emitted from emitters 12 are prevented from landing on unintended phosphor layers 16 and illuminating the same.

FIGS. 5*a*-5*f* are partial sectional views used to describe the processes involved in forming an electron emission device according to an exemplary embodiment of the present invention.

Figure 5A:
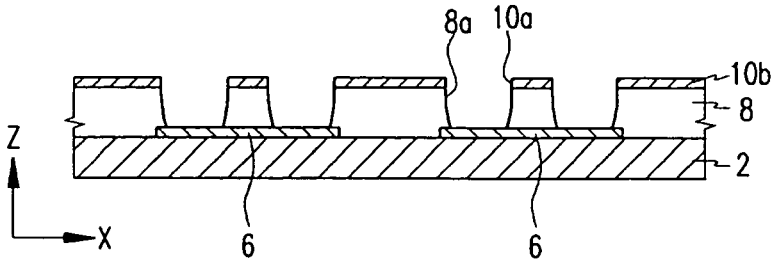
FIGS. 5*a*-5*f* are partial sectional views used to describe the processes involved in forming an electron emission device according to an exemplary embodiment of the present invention.

First, with reference to FIG. 5*a*, a conductive material such as ITO (indium tin oxide) is coated and patterned on first substrate 2 to thereby form cathode electrodes 6 in a stripe pattern. Next, an insulation material is deposited over the entire surface of first substrate 2 to form insulation layer 8. A thickness of insulation layer 8 is approximately 20 μm, and this thickness is realized by repeating (several times) the processes of thick-layer printing, drying, and baking.

Subsequently, a metal material (for example, chrome) is deposited to a thickness of 100-500 nm. The metal material is then patterned to thereby form first gate layers 10*b* in a stripe pattern and substantially perpendicular to cathode electrodes 6. A conventional photolithography process is then used to form openings 8*a* and 10*a* respectively in insulation layer 8 and first gate layer 10*b* at areas corresponding to where cathode electrodes 6 and first gate layers 10*b* intersect.

Figure 5B:
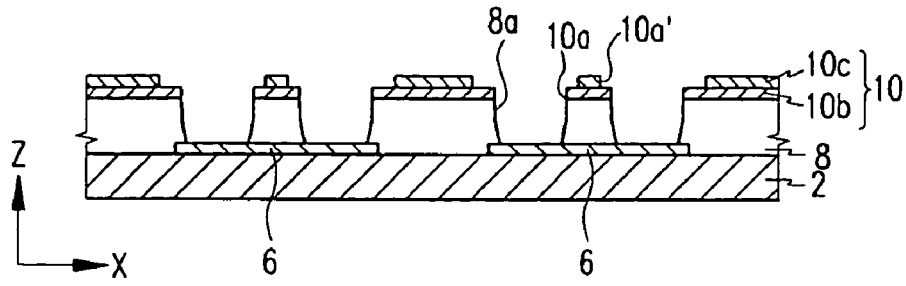

Next, with reference to FIG. 5*b*, a metal material (for example, silver) is deposited to a thickness of 100-500 nm on first gate layers 10*b*. The metal material is then patterned to thereby form second gate layers 10*c*. This completes the formation of first and second gate layers 10*b* and 10*c* that make up gate electrodes 10.

Figure 5C:
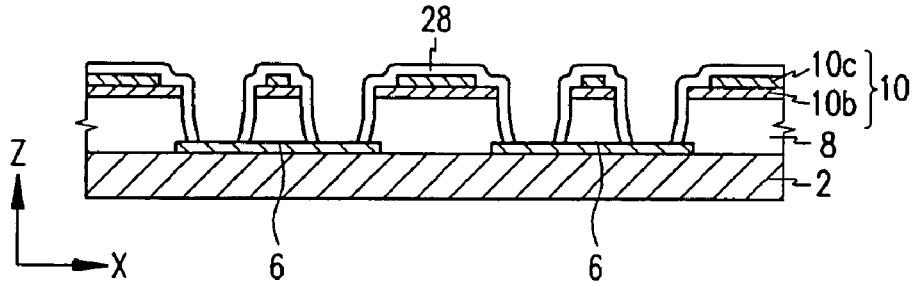

Referring to FIG. 5*c*, sacrificial layer 28 is formed over all exposed elements to a thickness of 100-500 nm. Then, predetermined areas of sacrificial layer 28 are removed through a photolithography process. Sacrificial layer 28 may be realized through a photoresist material or a metal material.

Figure 5D:
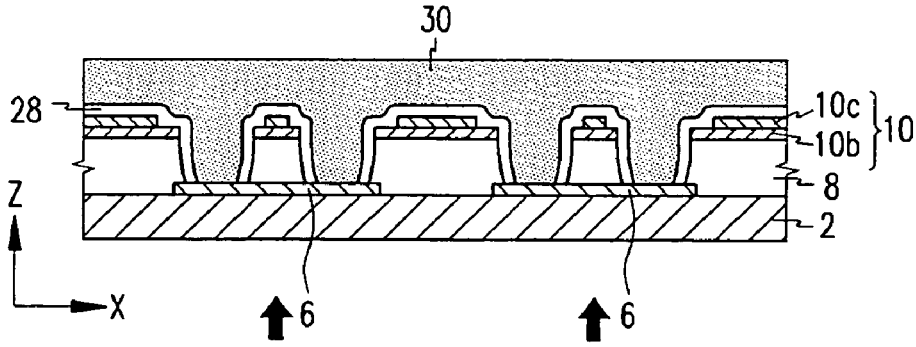
Figure 5E:
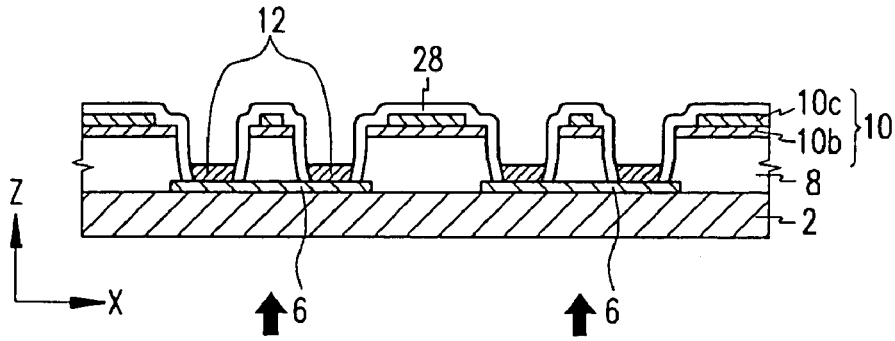

Subsequently, with reference to FIG. 5*d*, paste-like photosensitive emitter material 30 is formed over all exposed elements. For example, thick-layer printing may be performed using a photosensitive carbon-based material having as its main component carbon nanotubes. Next, ultraviolet rays (depicted by dark arrows) are irradiated onto first substrate 2 from a side of the same opposite the side on which the above elements are formed.

As a result, emitter material 30 is hardened at specific areas, that is, at areas of cathode electrodes 6 exposed by openings 8*a* and 10*a*. Emitter material 30 not hardened in this process is then removed to thereby result in the formation shown in FIG. 5*e*. As a result of the formation of sacrificial layer 28, emitters 12 are at a predetermined distance to insulation layer 8 and gate electrodes 10. This prevents short circuits from being formed between emitters 12 and gate electrodes 10.

Figure 5F:
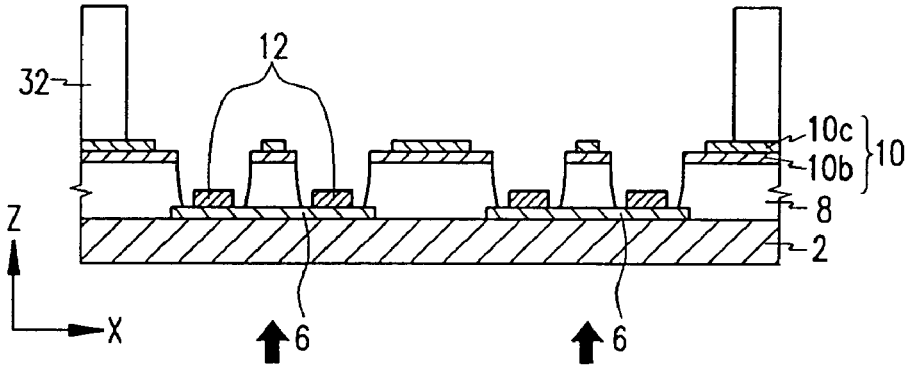

Next, with reference to FIG. 5*f*, sacrificial layer 28 is removed using an etching solution to thereby complete the structure of first substrate 2. When performing this process of removing sacrificial layer 28 using an etching solution, even if gate electrodes 10 become damaged, first gate layers 10*b* thereof remain intact as a result of being protected by second gate layers 10*c*. Hence, the resistance of gate electrodes 10 is not increased.

Included in this structure are spacers 32 that are formed on first substrate 2. With reference to FIG. 1, following the formation of anode electrode 14 and phosphor screen 20 on second substrate 4, a sealant (not shown) is formed around edges of first and second substrate 2 and 4 on opposing surfaces thereof. After first and second substrates 2 and 4 are interconnected, the space between these elements is evacuated to thereby form a vacuum assembly and complete the electron emission device.

FIGS. 6*a*-6*e* are partial sectional views used to describe the processes involved in forming an electron emission device according to another exemplary embodiment of the present invention.

Figure 6A:
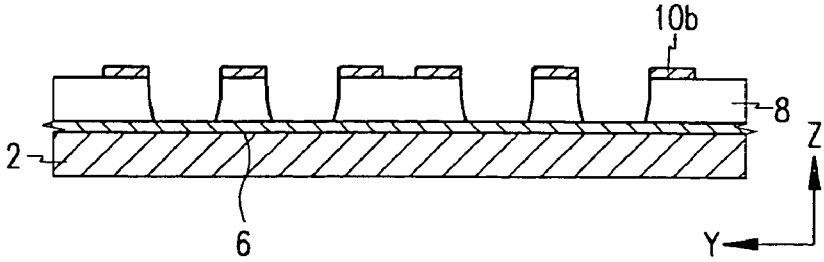
FIGS. 6*a*-6*e* are partial sectional views used to describe the processes involved in forming an electron emission device according to another exemplary embodiment of the present invention.

Referring first to FIG. 6*a*, cathode electrodes 6, insulation layer 8, and first gate layers 10*b* are formed on transparent first substrate 2. The configuration, materials, and method of formation of cathode electrodes 6, insulation layer 8, and first gate layers 10*b* are identical to those described with reference to the above exemplary embodiment.

Figure 6B:
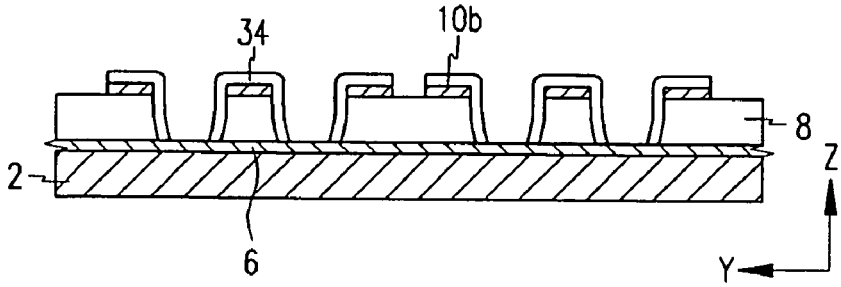

Next, with reference to the FIG. 6*b*, a metal material (for example, silver) is deposited to a thickness of 100-500 nm over all exposed elements of first substrate 2, then the metal material is patterned in the same stripe formation as first gate layers 10*b* to thereby form metal sacrificial layer 34. During patterning of metal sacrificial layer 34, areas of metal sacrificial layer 34, that is, portions present on cathode electrodes 6 are removed. Metal sacrificial layer 34 subsequently becomes second gate layers that form gate electrodes 10 together with first gate layers 10*b*.

Figure 6C:
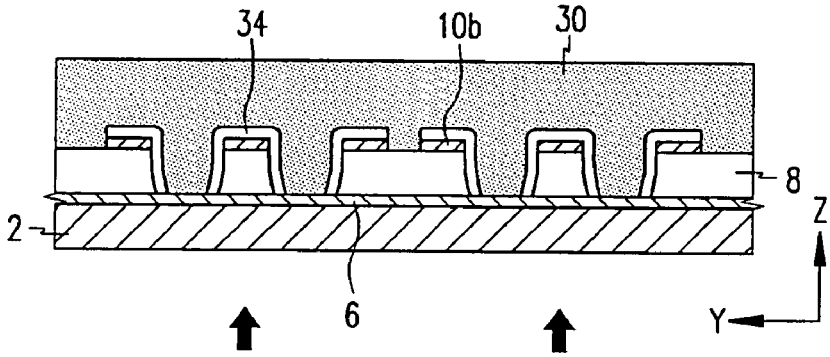
Figure 6D:
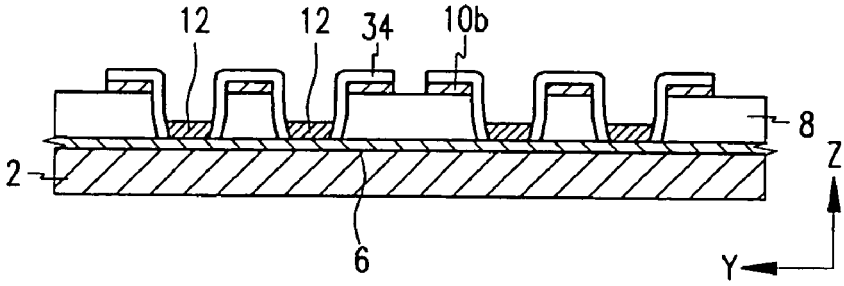

Referring to FIG. 6*c*, paste-like photosensitive emitter material 30 is formed over all exposed elements using thick-layer printing. Next, ultraviolet rays (depicted by dark arrows) are irradiated onto first substrate 2 from a side of the same opposite the side on which the above elements are formed. As a result, emitter material 30 is hardened at specific areas, that is, at areas where emitter material 30 is formed on cathode electrodes 6. Emitter material 30 not hardened in this process is then removed to thereby complete the formation of emitters 12 as shown in FIG. 6*d*.

Figure 6E:
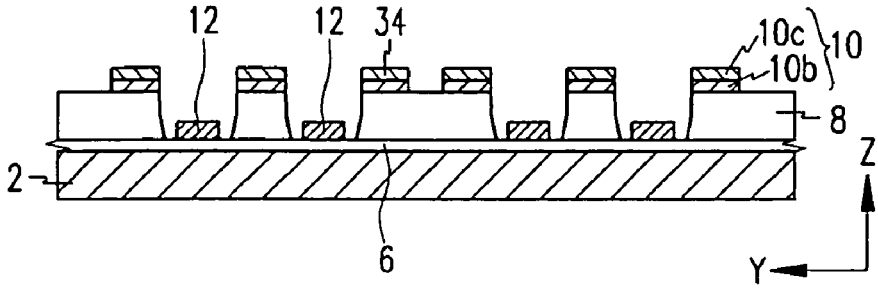

Subsequently, with reference to FIG. 6*e*, metal sacrificial layer 34 is removed except at areas where it is formed on first gate layers 10*b* to thereby form second gate layers 10*c* and complete gate electrodes 10. A conventional photolithography process is used to perform this operation. Next, using the same procedures as described with reference to the above exemplary embodiment, anode electrode 14 and phosphor screen 20 are formed on second substrate 4, then first and second substrates 2 and 4 are sealed and the gap therebetween evacuated.

In this exemplary embodiment, since metal sacrificial layer 34 becomes second gate layers 10*c*, manufacture is made simple by the fact that it is not necessary to form another sacrificial layer after the formation of second gate electrodes 10*c*. This minimizes damage to both first and second gate layers 10*b* and 10*c* to thereby maintain a high level of conductivity of resulting gate electrodes 10.

FIGS. 7*a*-7*e* are partial sectional views used to describe the processes involved in forming an electron emission device according to yet another exemplary embodiment of the present invention.

Figure 7A:
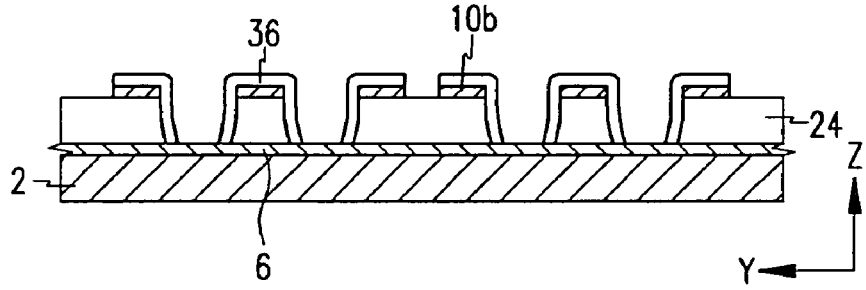
FIGS. 7*a*-7*e* are partial sectional views used to describe the processes involved in forming an electron emission device according to yet another exemplary embodiment of the present invention.

First, with reference to FIG. 7*a*, cathode electrodes 6, first insulation layer 24, first gate layers 10*b*, and metal sacrificial layer 36 are formed in this sequence on transparent first substrate 2. The configuration, materials, and method of formation of cathode electrodes 6, first gate layers 10*b*, and metal sacrificial layer 36 are identical to those described with reference to the exemplary embodiment of FIGS. 6*a*-6*e*; and the formation, material, and method of formation of first insulation layer 24 are identical to those of insulation layer 8 of the exemplary embodiment of FIGS. 6*a*-6*e*.

Figure 7B:
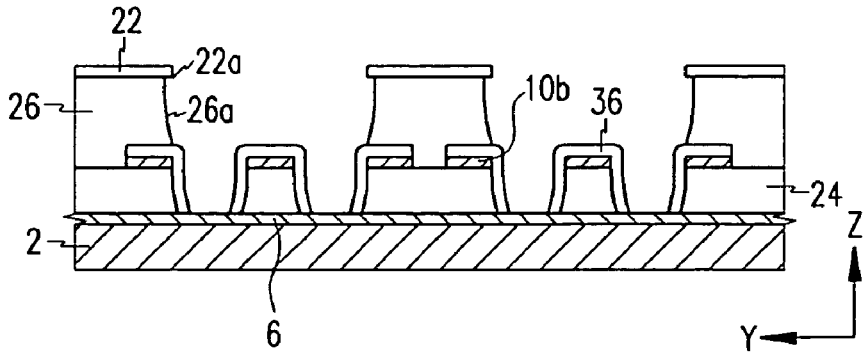

Next, with reference to the FIG. 7*b*, a dielectric paste is formed on first substrate 2 to a thickness of approximately 20 μm to form second insulation layer 26. This is performed by repeating the processes of thick-layer printing, drying, and baking. Next, metal is deposited on second insulation layer 26 to thereby form focusing electrodes 22. Focusing electrodes 22 and second insulation layer 26 are then patterned to form openings 22*a* and 26*a* for exposing the emitters to be formed in a subsequent process.

Figure 7C:
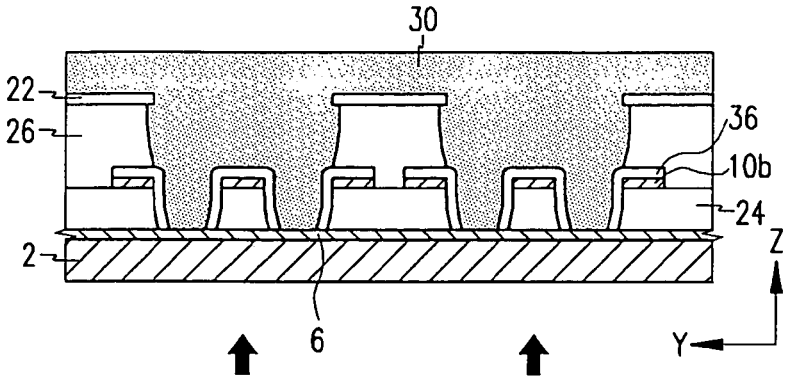
Figure 7D:
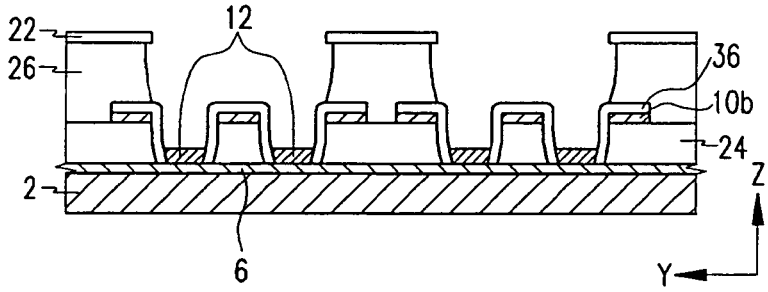

Following the above, with reference to FIG. 7*c*, paste-like photosensitive emitter material 30 is formed over all exposed elements of first substrate 2 using thick-layer printing. Next, ultraviolet rays (depicted by dark arrows) are irradiated onto first substrate 2 from a side of the same opposite the side on which the above elements are formed. As a result, emitter material 30 is hardened at specific areas, that is, at areas where it is formed on cathode electrodes 6. Emitter material 30 not hardened in this process is then removed to thereby complete the formation of emitters 12 as shown in FIG. 7*d*.

Figure 7E:
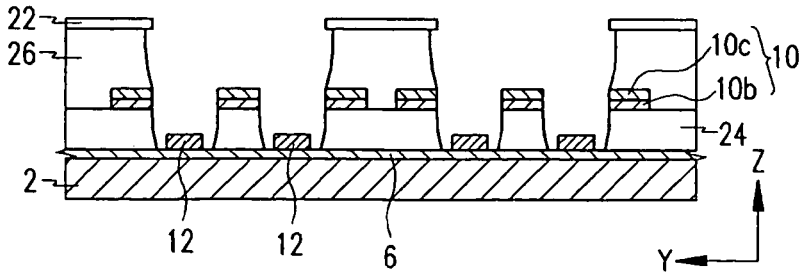
Figure 8:
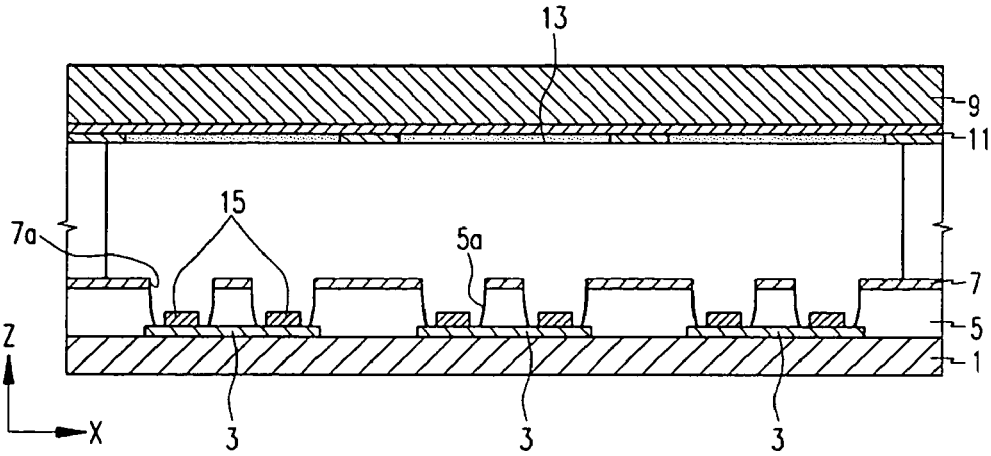
FIG. 8 (Prior Art)
FIG. 8 is a partial sectional view of a conventional FEA type electron emission device.
Figure 9A:
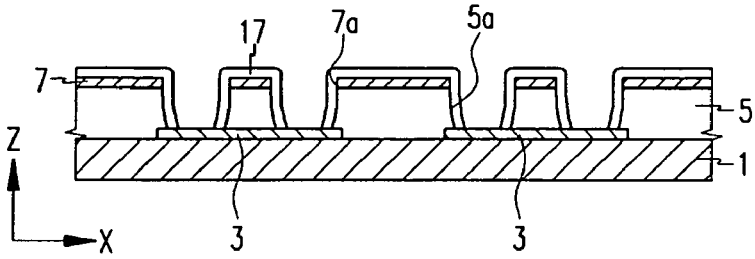
FIG. 9a (Prior Art)
FIGS. 9*a*-9*d* are partial sectional views used to describe the processes involved in forming emitters in the production of a conventional FEA type electron emission device.
Figure 9B:
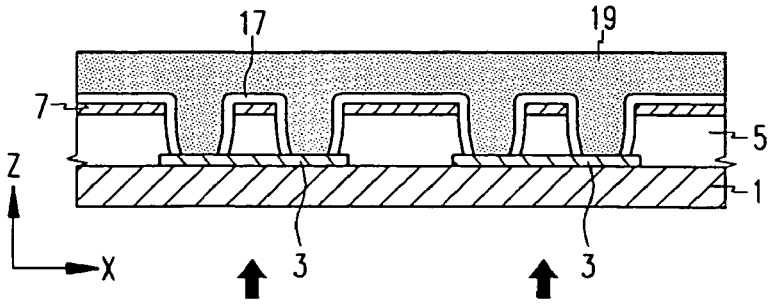
FIG. 9b (Prior Art)
Figure 9C:
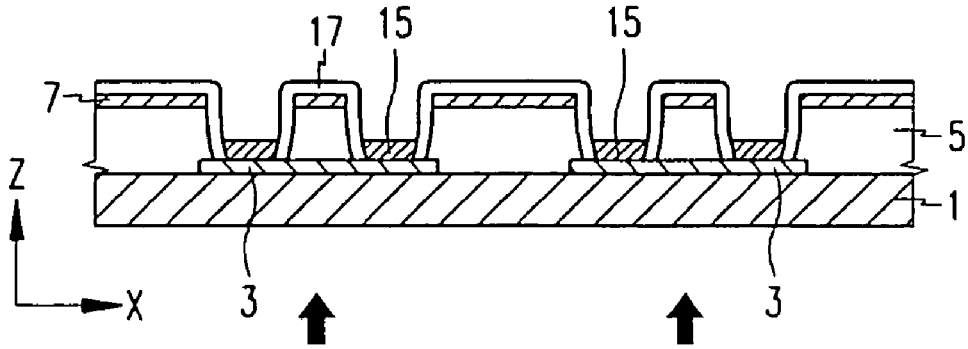
FIG. 9c (Prior Art)
Figure 9D:
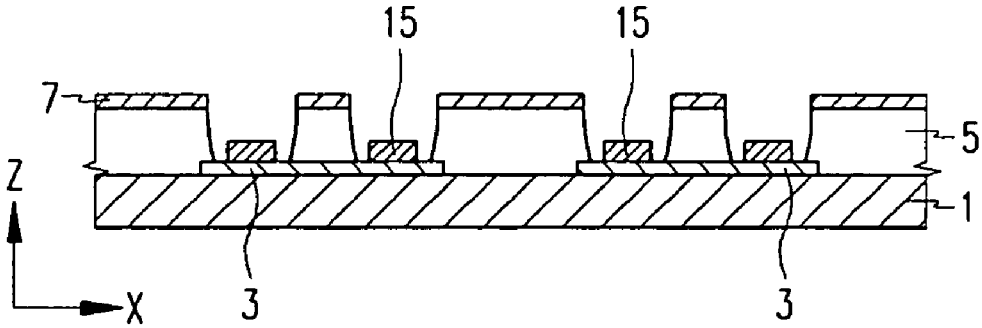
FIG. 9d (Prior Art)

Subsequently, with reference to FIG. 7*e*, metal sacrificial layer 36 is removed except at areas where it is formed on first gate layers 10*b* to thereby form second gate layers 10*c* and complete gate electrodes 10. A conventional photolithography process using a mask is employed in this operation. Next, using the same procedures as described with reference to the exemplary embodiment of FIGS. 5*a*-5*f*, anode electrode 14 and phosphor screen 20 are formed on second substrate 4, then first and second substrates 2 and 4 are sealed and the gap therebetween evacuated.

In this exemplary embodiment, manufacture is made simple by the fact that it is not necessary to form an additional sacrificial layer. Also, second gate layers 10*c* are formed covering second insulation layer 26 such that damage to second gate layers 10*c* occurring during manufacture is minimized. Therefore, an increase in the resistance of gate electrodes 10 is prevented.

In the present invention described above, a multi-layered structure is used for the gate electrodes such that the layer in direct contact with the insulation layer is undamaged following etching processes. As a result, an increase in the resistance of the gate electrodes is prevented. By maintaining a certain level of conductivity of the gate electrodes, uniform emission of electrons from the emitters is realized.

In the above embodiments, the FEA type is illustrated as the electron emission device. However, the electron emission device of the present invention is not limited to the FEA type.

Although embodiments of the present invention have been described in detail hereinabove in connection with certain exemplary embodiments, it should be understood that the invention is not limited to the disclosed exemplary embodiments, but, on the contrary, is intended to cover various modifications and/or equivalent arrangements included within the spirit and scope of the present invention, as defined in the appended claims.

What is claimed is:

1. An electron emission device, comprising:

a first substrate and a second substrate opposing one another with a predetermined gap therebetween, and interconnected using a sealant to thereby form a vacuum assembly;

cathode electrodes formed on the first substrate;

gate electrodes being insulated with the cathode electrodes and being formed of a multi-layered structure of at least two layers, the at least two layers being of a substantially same corresponding lateral shape and thickness range;

an anode electrode formed on the second substrate; and a phosphor screen formed on the anode electrode, wherein the at least two layers of each of the gate electrodes include a first gate layer and a second gate layer made of different metals.

2. The electron emission device of claim 1, further comprising electron emission sources formed on the cathode electrodes.

3. The electron emission device of claim 2, wherein the electron emission sources are made of one of carbon nanotubes, graphite, diamond, diamond-like carbon, C60, and a combination of these materials.

4. The electron emission device of claim 1, wherein the first gate layer and the second gate layer are etched by etchants different from each other.

5. The electron emission device of claim 1, wherein the different metals are selected from combinations of chrome and silver, chrome and aluminum, and aluminum and silver.

6. The electron emission device of claim 1, wherein each of the first gate layer and the second gate layer is made to a thickness of 100-500 nm.

7. The electron emission device of claim 1, further comprising focusing electrodes mounted on the gate electrodes with an insulation layer interposed therebetween.

8. A gate electrode apparatus for an electron emission device having a substrate with cathode electrodes formed on the substrate, an insulation layer layered on the cathode electrodes, and emitters formed on the cathode electrodes within insulation layer openings in the insulation layer, the gate electrode apparatus comprising:

a first gate layer formed on the insulation layer; and a second gate layer layered on the first gate layer;

wherein the first gate layer and the second gate layer have respective openings located to expose the emitters, wherein the first gate layer and the second gate layer have a substantially same corresponding lateral shape and thickness range, and wherein the first gate layer and the second gate layer are made of different metals selected from combinations of chrome and silver, chrome and aluminum, and aluminum and silver.

* * * * *